US006458044B1

(12) United States Patent
Vincent et al.

(10) Patent No.: US 6,458,044 B1
(45) Date of Patent: Oct. 1, 2002

(54) GOLF CLUB HEAD AND METHOD FOR MAKING IT

(75) Inventors: Benoit Vincent, Leucadia, CA (US); Michael Scott Burnett, Carlsbad, CA (US); Joseph H. Hoffman, Carlsbad, CA (US); Chris Mason, Carlsbad, CA (US); Stephen A. Kraus, San Diego, CA (US); Allan C. Saliba, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 09/881,398

(22) Filed: Jun. 13, 2001

(51) Int. Cl.[7] ..... A63B 53/04

(52) U.S. Cl. ..... 473/334; 473/337; 473/345; 473/409

(58) Field of Search ..... 473/324, 334, 473/335, 336, 337, 338, 339, 345, 346, 349, 256, 409

(56) References Cited

U.S. PATENT DOCUMENTS

| | | | | |
|---|---|---|---|---|
| 1,538,312 | A | | 5/1925 | Beat |
| 1,549,993 | A | | 8/1925 | Klin |
| 1,665,523 | A | | 4/1928 | Boyce |
| 2,163,091 | A | | 6/1939 | Held |
| 2,447,967 | A | | 8/1948 | Stone |
| 2,750,194 | A | * | 6/1956 | Clark |
| 3,606,327 | A | * | 9/1971 | Gorman |
| 3,897,066 | A | | 7/1975 | Belmont |
| D245,634 | S | | 8/1977 | Churchward |
| 4,043,563 | A | | 8/1977 | Churchward |
| 4,085,934 | A | | 4/1978 | Churchward |
| 4,340,230 | A | | 7/1982 | Churchward |
| 4,695,054 | A | | 9/1987 | Tunstall |
| 4,754,977 | A | | 7/1988 | Sahm |
| 4,811,950 | A | | 3/1989 | Kobayashi |
| 4,869,507 | A | | 9/1989 | Sahm |
| 5,013,041 | A | | 5/1991 | Sun et al. |

(List continued on next page.)

FOREIGN PATENT DOCUMENTS

| | | |
|---|---|---|
| GB | 2 011 261 | 7/1979 |
| JP | 62-41674 | 2/1987 |
| WO | WO 00/43080 | 7/2000 |
| WO | WO 01/66199 A1 | 9/2001 |

*Primary Examiner*—Sebastiano Passaniti
(74) *Attorney, Agent, or Firm*—Sheppard, Mullin, Richter & Hampton LLP; James R. Brueggemann

(57) ABSTRACT

An improved golf club head is disclosed, in which a desired weight for the head is precisely controlled by installing into a cavity formed in the rear wall of the club head's hollow main body a selected weight cartridge from a group of such cartridges having identical sizes but a range of weights. The selected weight cartridge is installed simply by sliding it into the rear wall cavity, where it is retained by a snap fit, and/or by an interference fit, and/or by a suitable bonding material, without the need for a screw attachment. This greatly simplifies the golf club head's manufacture, thus reducing its cost. The invention is applicable to golf club heads of all kinds, including metal woods, irons and putters.

28 Claims, 2 Drawing Sheets

U.S. PATENT DOCUMENTS

| | | | |
|---|---|---|---|
| 5,050,879 | A | 9/1991 | Sun et al. |
| 5,316,305 | A | 5/1994 | McCabe |
| 5,385,348 | A | 1/1995 | Wargo |
| 5,518,243 | A | 5/1996 | Redman |
| 5,540,436 | A | 7/1996 | Boone |
| 5,547,427 | A | 8/1996 | Rigal et al. |
| 5,720,674 | A | 2/1998 | Galy |
| 5,906,549 | A | 5/1999 | Kubica |
| 5,916,042 | A | 6/1999 | Reimers |
| 5,918,408 | A | 7/1999 | Laney |
| 5,947,840 | A | 9/1999 | Ryan |
| 6,015,354 | A | 1/2000 | Ahn et al. |
| 6,089,994 | A | 7/2000 | Sun |
| 6,123,627 | A | 9/2000 | Antonious |
| D438,584 | S | 3/2001 | Adams et al. |
| D438,925 | S | 3/2001 | Adams et al. |
| D438,926 | S | 3/2001 | Adams et al. |
| 6,206,790 | B1 | 3/2001 | Kubica et al. |
| 6,210,290 | B1 | 4/2001 | Erickson et al. |
| D441,415 | S | 5/2001 | Helmstetter et al. |

* cited by examiner

GOLF CLUB HEAD AND METHOD FOR MAKING IT

BACKGROUND OF THE INVENTION

This invention relates generally to golf club heads and to methods for making them and, more particularly, to golf club heads and related methods in which the club head incorporates an added weight component to provide the head with a desired weight.

One important parameter of golf clubs is the weight of their heads, which must be carefully controlled, not only to meet the particular needs of the individual golfer using the club, but also to combine with the golfer's other clubs to form a matched set. Golf club manufacturers, therefore, customarily weigh each club head during the manufacturing process and add one or more components of precise weight so as to adjust the club head's weight to a desired overall value.

The added components for adjusting the club head's weight have taken many different forms. One common form, which has been used with metal wood-type golf club heads, is a material such as epoxy that is added in selected amounts to the club head's hollow cavity. Although this use of epoxy has been generally effective in correcting for weight variances in golf club heads, negative side effects can result. For example, the epoxy can affix to the inner surface of the club head's ball-striking face, which can have adverse effects, such as lowering the face's coefficient of restitution. Also, pooling of the epoxy can displace the club's center of gravity, and can affect the club head's sound at ball impact, in an indeterminate way.

Another common form for the added weight component has been a metallic plug installed into the hollow shaft of the club, where it joins to the club head's hosel. Although generally effective in providing the club head with the desired weight, such metallic plugs sometimes can loosen and cause undesired rattling during the club's use. In addition, placement of such weights within the shaft can move the club head's center of gravity to an undesired location. Further, if the need ever arises to replace the club's shaft, the weight will necessarily be removed and an equivalent weight might not be installed in its place.

Yet another common form for the added weight component has been a plurality of metallic weights carried within correspondingly sized cavities formed in a housing that is secured, e.g., by screws, to a portion of the golf club head, typically the sole. Although generally effective in providing the club head with the desired weight, the process of assembling such weight components is considered to require excessive manufacturing effort and cost. Also, the housing and/or weight components sometimes can loosen during the club's use.

It should therefore be appreciated that there is a need for an improved golf club head, and method for making it, in which the head's weight can be tailored to a precisely selected value, without adversely affecting important parameters such as the club head's coefficient of restitution or center of gravity, without being susceptible to loosening when the club is used or when the club's shaft is removed or replaced, and without requiring excessive time and effort during manufacture. The present invention fulfills this need and provides further related advantages.

SUMMARY OF THE INVENTION

The present invention resides in an improved golf club head, and in a method for making it, in which the weight of the head is tailored to a precisely selected value without adversely affecting club head parameters such as coefficient of restitution or center of gravity, without being susceptible to loosening when the club head is used or when the associated shaft is removed or replaced, and without requiring excessive time and effort during manufacture. The golf club head includes a hollow main body having a sole, a crown, a heel, a toe, a ball-striking face, and a rear wall, with the heel defining a hosel for receiving the lower end of a shaft, and the rear wall defining a rear wall cavity for receiving a special weight cartridge. The hollow main body defines a central axis along which the head is intended to move when being used to strike a golf ball. The weight cartridge includes a polymeric housing having one or more elongated cavities for conformably receiving one or more weights. The rear wall cavity is substantially aligned with the central axis and is sized and configured to conformably and slidably receive the polymeric housing, along an axis substantially aligned with the central axis. The weight cartridge is secured within the rear wall cavity, in an installation position, without the need for a screw attachment.

The weight cartridge is selected from a plurality of weight cartridges, all having substantially the same size and shape, but each having a different weight. The particular weight cartridge is selected so that its weight will provide the golf club head with the desired total weight.

In its preferred form, the rear wall cavity has a substantially rectangular cross-section in planes perpendicular to the central axis, and spaced above the sole of the head. The weight cartridge is retained in its installation position within the rear wall cavity by a snap fit, and/or by an interference fit, and/or by a bonding material such as double-sided tape and/or epoxy. When a snap fit attachment is being used, the housing and cavity, together, include a cooperating ridge and groove structure.

The one or more weights preferably comprise material selected from the group consisting of polymers, aluminum, steel and tungsten. The cavities defined by the polymeric housing preferably are at least three in number, each cavity having an elongated, substantially cylindrical shape, and the plurality of weights each have a substantially cylindrical shape sized to fit snugly within these cavities. The plurality of weight cartridges have weights that range from about 3 g to about 16 g, which represents about 1.5% to about 8% of the golf club head's total weight.

In yet further more detailed features of the invention, the polymeric housing has a top wall, a bottom wall, a front wall, left and right side walls, and a rear wall, and substantially only the rear wall of the housing is visible when the housing is located in its installation position. The cavities define by the polymeric housing open into a wall of the housing other than the rear wall, such that the weights are prevented from exiting the housing when the housing is located in its installation position. Preferably, the cavities open into the front wall of the housing, and they are oriented with their longitudinal axes substantially parallel with each other and with the club head's central axis.

Other features and advantages of the invention should become apparent from the following description of the preferred embodiment, taken in conjunction with the accompanying drawings, which illustrate, by way of example, the principles of the invention.

DESCRIPTION OF THE PREFERRED EMBODIMENT

Figure 1:
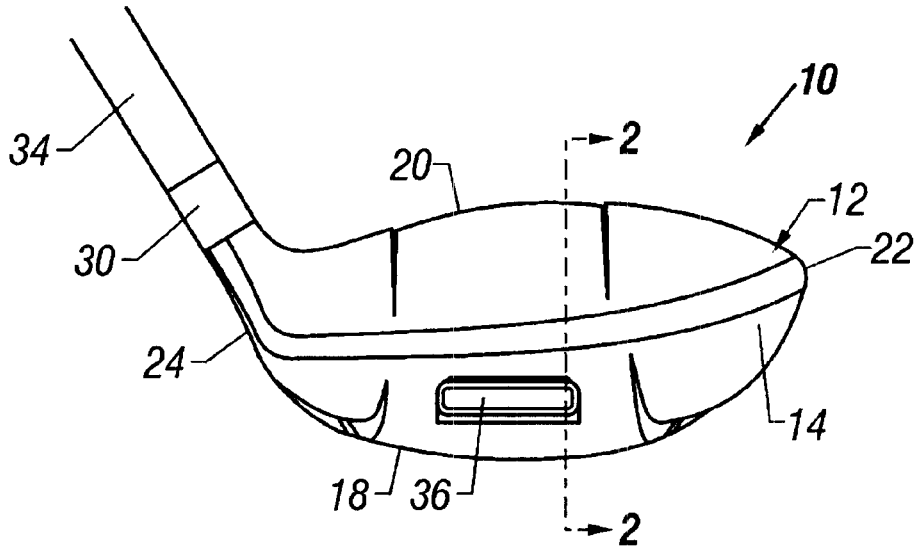
FIG. 1 is a rear elevational view of a metalwood-type golf club constructed in accordance with the invention, with a weight cartridge being shown in its installation position within a cavity formed in the golf club head's rear wall.
Figure 2:
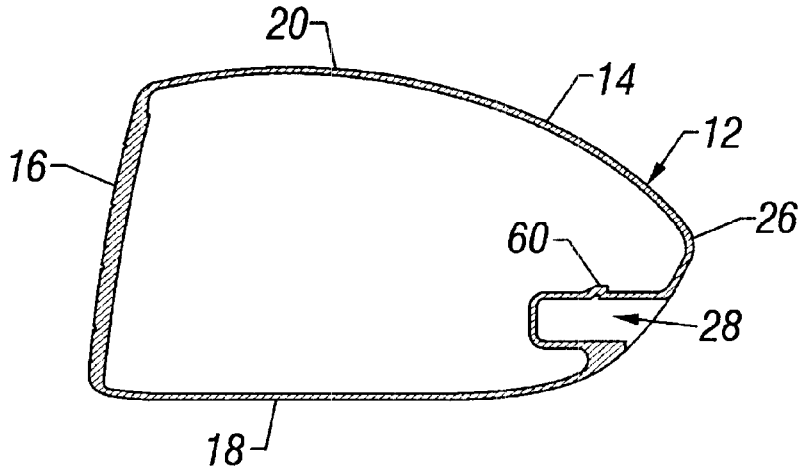
FIG. 2 is left side sectional view of the golf club of FIG. 1, taken substantially in the direction of the arrows 2—2 in FIG. 1, shown with the weight cartridge removed from the cavity of the golf club head's rear wall.
Figure 3:
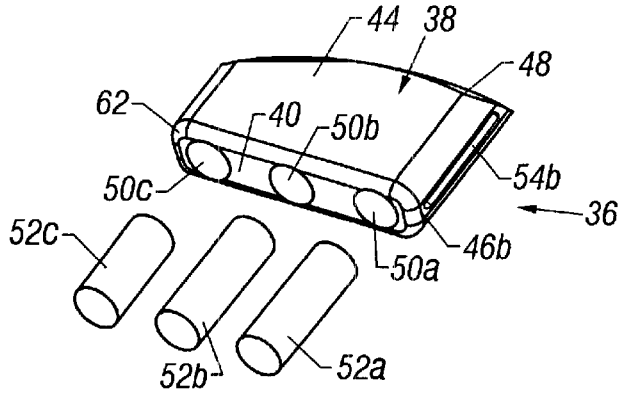
FIG. 3 is an exploded bottom perspective view of the weight cartridge.
Figure 4:
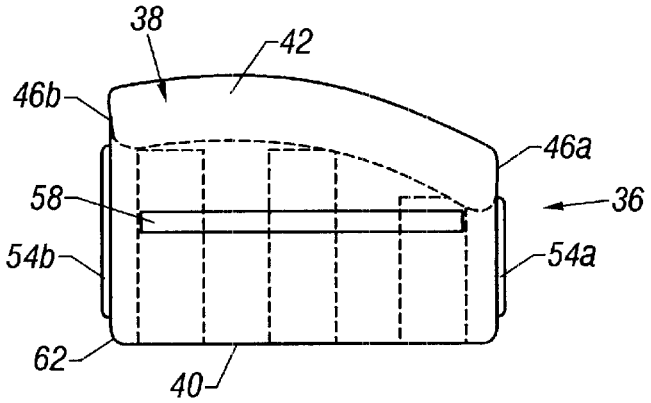
FIG. 4 is a top plan view of the weight cartridge of FIG. 3.
Figure 5:
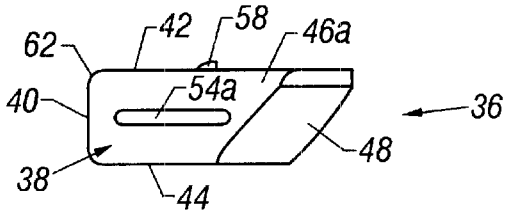
FIG. 5 is a left side elevational view of the weight cartridge of FIG. 3.
Figure 6:
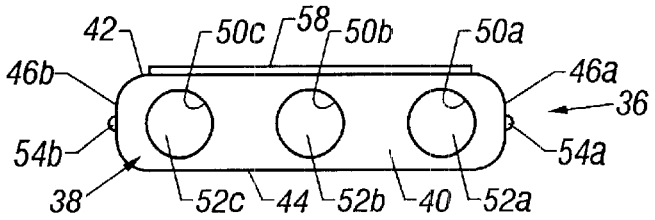
FIG. 6 is a rear elevational view of the weight cartridge of FIG. 3.

With reference now to the illustrative drawings, and particularly to FIGS. 1–3, there is shown a metal wood-type golf club 10 having a hollow club head 12 that is specially weighted to a desired value. The club head is manufactured by any of a number of suitable techniques. For example, the head can include a hollow main body 14 and a face plate 16, which are formed separately and then joined together by suitable means, such as welding. The main body defines a sole 18, a crown 20, a toe 22, and a heel 24, which cooperate to define an opening sized to match the peripheral shape of the face plate. A rear wall 26 separates the crown from the sole and the heel from the toe, and a mid-portion of that rear wall carries a special box-shaped cavity 28, spaced above the sole. A hosel 30 located at the heel 24 of the club head's main body 14 defines an elongated cavity (not shown) for receiving the lower end of a shaft 34. The main body can be formed by any suitable means, such as casting, and the face plate likewise can be formed by any suitable means, such as forging or, alternatively, cold forming a flat sheet of constant or variable thickness.

Before the shaft 34 is installed into the hosel cavity, the club head 12 is assembled by joining together the face plate 16 and the main body 14, e.g., by welding or brazing. At this time, manufacturing tolerances can cause the club head's weight to vary within a limited range. Generally, it is desired to adjust this variable weight to a more precise value, which is selected to match the needs of the particular golfer who will be using the club 10.

In accordance with the invention, the weight of the club head 12 is adjusted to the desired value by installing a special weight cartridge 36 (see FIGS. 3–6) into the cavity 28 defined in the main body's rear wall 26. The weight cartridge is selected from a group of several cartridges, which range in mass between the minimum and maximum values that might be required to bring the combined head/cartridge weight to the desired value. Typically, a suitable range of values will be from about 3.5 g to about 15.5 g, which represents about 1.5% to about 8% of the combined weight of the cartridge and the club head's hollow main body. The particular cartridge to be selected is determined simply by weighing the head and subtracting that value from the desired club head weight.

All of the weight cartridges 36 in the group of cartridges include a polymeric housing 38 sized and dimensioned to conform to the shape of the rear wall cavity 28. Specifically, the cartridges each have a general box shape, with front wall 40, a top wall 42, a bottom wall 44, left and right side walls 46*a* and 46*b*, respectively, and a rear wall 48. Each has a width of about 30 mm and a height of about 7 mm. The rear wall is configured so as to conform with the general shape of the main body's rear wall 26. The cartridge's length ranges from a minimum of about 11 mm to a maximum of about 19 mm.

The polymeric housing 38 of each weight cartridge 36 can be formed of materials such as: (1) polyvinyl chloride, having a specific gravity of 1.23 and a durometer of Shore A70 to A80, (2) polyurethane, having a specific gravity of 1.15 and a durometer of Shore A90 to A100, or (3) polymethyl methacrylate, having a specific gravity of 1.15 and a durometer of Shore D75. The housing can be made by any conventional method, including injection molding, compression molding and casting. The housing can be either tinted or clear.

Three elongated cylindrical cavities 50*a*, 50*b* and 50*c* extend rearwardly from the front wall 40 of the cartridge's polymeric housing 38. These cavities are sized to receive and retain special cylindrical rods 52*a*, 52*b* and 52*c*, respectively, that provide the cartridge 36 with the desired total weight. In the preferred embodiment, the rods are formed of materials having a range of densities, including polymers, aluminum, steel, and two tungsten alloys. The cavities are sized to retain the rods within them by an interference fit.

The polymeric housing 38 of the weight cartridge 36 is configured to be slidable forwardly into the rear wall cavity 26 to an installation position (FIG. 2) in which it is retained by a snap fit. To that end, the housing's side walls 46*a* and 46*b* include elongated ridges 54*a* and 54*b* sized to be slidably received in mating grooves (not shown) formed in the respective left and right side walls of the rear wall cavity. A transverse ridge 58 formed in the housing's top wall 42 mates with a corresponding transverse groove 60 formed in the top wall of the rear wall cavity when the cartridge is in its installation position. The cartridge thereby is retained within the rear wall cavity by a snap fit. It will, of course, be appreciated that the locations of the transverse ridge and mating groove alternatively could be reversed with each other.

Alternatively, the polymeric housing 38 of the weight cartridge 36 could be configured to be retained in its installation position by an interference fit and/or by a suitable bonding material, e.g., double-sided adhesive tape, epoxy, and/or other adhesive. In that case, the housing still could be aligned within the rear wall cavity 26 by configuring the housing's side walls 46*a* and 46*b* to include elongated ridges 54*a* and 54*b* that are slidably received in mating grooves formed in the cavity's respective left and right side walls.

As mentioned above, the rods 52*a*, 52*b* and 52*c* are formed of materials having a range of densities, including a polymer, aluminum, steel, and two tungsten alloys. The lightest of the weight cartridges 36 carries rods that all are formed of a polymer, and the heaviest of the cartridges carries rods that all are formed of one of the tungsten alloys. The polymer has a density of 0.9 g/cc, the aluminum a density of 2.7 g/cc, the steel a density of 7.8 g/cc, a first tungsten alloy (i.e., Tungsten I) a density of 12.5 g/cc, and a second tungsten alloy (i.e., Tungsten II) a density of 16 g/cc. The lightest of the cartridges has a mass of 3.5 g, which represents about 1.5% of the club head's final weight, and the heaviest of the cartridges has a mass of 15.4 g, which represents about 8% of the club head's final weight.

By way of example, a range of weight cartridges 36 incorporating rods 52*a*, 52*b* and 52*c* formed from the materials set forth in Table 1 can be provided:

TABLE 1

| Cartridge # | Rod 52a | Rod 52b | Rod 52c | Mass (g) |
|---|---|---|---|---|
| 1 | Polymer | Polymer | Polymer | 3.5 |
| 2 | Aluminum | Aluminum | Polymer | 4.5 |
| 3 | Polymer | Aluminum | Steel | 5.5 |
| 4 | Aluminum | Steel | Aluminum | 6.4 |
| 5 | Aluminum | Steel | Steel | 7.5 |
| 6 | Aluminum | Steel | Tungsten I | 8.5 |
| 7 | Aluminum | Tungsten I | Tungsten I | 9.8 |
| 8 | Aluminum | Tungsten I | Tungsten II | 10.6 |
| 9 | Aluminum | Tungsten II | Tungsten II | 11.6 |
| 10 | Tungsten I | Tungsten I | Tungsten I | 12.6 |
| 11 | Tungsten I | Tungsten I | Tungsten II | 13.4 |
| 12 | Tungsten I | Tungsten II | Tungsten II | 14.4 |
| 13 | Tungsten II | Tungsten II | Tungsten II | 15.4 |

In use, the selected weight cartridge 36 is simply slid into the cavity 28 formed in the rear wall 26, where it is retained in its installation position by a snap fit between the transverse ridge 58 and groove 60. A bevel 62 around the cartridge's front wall 40 facilitates this insertion. In the cartridge's installation position, the cartridge's rear wall 48 blends smoothly with the outer surface of the main body's rear wall, to provide the club head 12 with a pleasing outer appearance. Of course, as discussed above, an interference fit and/or a suitable bonding material could supplement, or substitute for the snap-fit.

After the selected weight cartridge 36 has been installed into the rear wall cavity 28, the shaft 30 is installed into the hosel 30, where it is secured by a suitable adhesive (not shown). This completes the assembly of the golf club 10.

It should be appreciated from the foregoing description that the present invention provides an improved golf club head 10, wherein a desired weight for the head can be precisely controlled. The desired head weight is provided by selecting one weight cartridge 36 from a group of such cartridges, having identical sizes but a range of weights, and by then installing the selected cartridge into a special rear wall cavity 28 formed in the rear wall 26 of the club head's main body 14. The cartridge is installed simply by sliding it into the rear wall cavity, where it is retained by a snap fit, and/or an interference fit, and/or by a suitable bonding material, without the need for a screw attachment. This greatly simplifies the golf club's manufacture, thus reducing its cost. The invention is applicable to golf clubs of all kinds, including metal woods, irons and putters.

Although the invention has been disclosed with reference only to the presently preferred embodiment, those skilled in the art will appreciate that various modifications can be made with departing from the invention. Accordingly, the invention is limited only by the following claims.

We claim:

1. A golf club head comprising:

a hollow main body having a sole, a crown, a heel, a toe, a ball-striking face, and a rear wall, wherein the rear wall defines a rear wall cavity, and wherein the hollow main body defines a central axis along which the head is intended to move when being used to strike a golf ball; and a weight cartridge including a polymeric housing and a weight, wherein the polymeric housing defines an elongated cavity sized and configured to conformably receive the weight;

wherein the rear wall cavity is substantially aligned with the central axis and is sized and configured to conformably and slidably receive the polymeric housing of the weight cartridge, along an axis substantially aligned with the central axis;

wherein the rear wall cavity includes an upper wall, a lower wall, a heel-ward wall, and a toe-ward wall, each extending into the hollow main body;

and wherein the rear wall cavity is configured to retain the weight cartridge in an installation position without the need for a screw attachment.

2. A golf club head as define in claim 1, wherein the rear wall cavity and the polymeric housing of the weight cartridge, together, include a ridge and groove structure that retains the weight cartridge in its installation position by a snap fit.

3. A golf club head as define in claim 2, wherein the rear wall cavity is spaced above the sole of the hollow main body.

4. A golf club head as defined in claim 1, wherein the rear wall cavity and the polymeric housing of the weight cartridge both are dimensioned in a direction from the heel to the toe greater than they are dimensioned in a direction from the sole to the crown.

5. A golf club head as define in claim 1, wherein:

the rear wall cavity has a substantially rectangular cross-section in planes perpendicular to the central axis;

the polymeric housing has a top wall, a bottom wall, a forward wall, a left side wall, a right side wall, and a rear wall; and when the housing is located in its installation position, substantially only the rear wall of the housing is visible from the golf club head's exterior.

6. A golf club head as define in claim 5, wherein:

the weight cartridge includes a plurality of weights, and the polymeric housing of the weight cartridge defines a plurality of elongated cavities sized and configured to conformably receive the plurality of weights; and the elongated cavities define by the polymeric housing open into a wall of the housing other than the rear wall, such that the weights are prevented from exiting the housing when the housing is located in its installation position.

7. A golf club head as define in claim 6, wherein:

the elongated cavities defined by the polymeric housing include at least three cavities, each having a substantially circular cross-section; and the plurality of weights each have a substantially circular cross-section and are sized to fit snugly within one of the plurality of elongated cavities.

8. A golf club head as defined in claim 6, wherein the plurality of elongated cavities defined by the polymeric housing open into the front wall of the housing and are oriented with their longitudinal axes substantially parallel with each other and with the central axis.

9. A golf club head as define in claim 1, wherein the weight comprises a material selected from the group consisting of polymers, aluminum, steel and tungsten.

10. A golf club head comprising:

a hollow main body having a sole, a crown, a heel, a toe, a ball-striking face, and a rear wall, wherein the rear wall defines a rear wall cavity; and a weight cartridge including a polymeric housing and a weight, wherein the polymeric housing defines an elongated cavity sized and configured to conformably receive the weight;

wherein the rear wall cavity includes an upper wall, a lower wall, a heel-ward wall, and a toe-ward wall, each extending into the hollow main body;

and wherein the polymeric housing of the weight cartridge is sized and configured to be conformably and slidably received within the rear wall cavity and to be retained in an installation position therein by a snap fit.

11. A golf club head as defined in claim 10, wherein:

the hollow main body defines a central axis along which the head is intended to move when being used to strike a golf ball;

the rear wall cavity is substantially aligned with the central axis; and the polymeric housing of the weight cartridge is configured to be slidable into the rear wall cavity along an axis aligned with the central axis.

12. A golf club head as defined in claim 11, wherein the rear wall cavity and the polymeric housing of the weight cartridge, together, include a ridge and groove structure that retains the weight cartridge in its installation position by the snap fit.

13. A golf club head as defined in claim 10, wherein the rear wall cavity and the polymeric housing of the weight cartridge both are dimensioned in a direction from the heel to the toe greater than they are dimensioned in a direction from the sole to the crown.

14. A golf club head as defined in claim 13, wherein the rear wall cavity is spaced above the sole of the head.

15. A golf club head as defined in claim 10, wherein:

the rear wall cavity has a substantially rectangular cross-section in planes perpendicular to the central axis;

the polymeric housing has a top wall, a bottom wall, a forward wall, a left side wall, a right side wall, and a rear wall; and when the housing is located in its installation position, substantially only the rear wall of the housing is visible from the golf club's exterior.

16. A golf club head as defined in claim 15, wherein:

the weight cartridge includes a plurality of weights, and the polymeric housing of the weight cartridge defines a plurality of elongated cavities sized and configured to conformably receive the plurality of weights; and the elongated cavities defined by the polymeric housing open into a wall of the housing other than the rear wall, such that the weights are prevented from exiting the housing when the housing is located in its installation position.

17. A golf club head as define in claim 16, wherein:

the elongated cavities define by the polymeric housing include at least three cavities, each having a substantially circular cross-section; and the plurality of weights each have a substantially circular cross-section and are sized to fit snugly within one of the plurality of elongated cavities.

18. A golf club head as defined in claim 16, wherein the plurality of elongated cavities define by the polymeric housing open into the front wall of the housing and are oriented with their longitudinal axes substantially parallel with each other and with the central axis.

19. A golf club head as defined in claim 10, wherein the weight comprises a material selected from the group consisting of polymers, aluminum, steel and tungsten.

20. A method for making a golf club head having a desired weight, comprising:

forming a hollow main body having a sole, a crown, a heel, a toe, a ball-striking face, and a rear wall, wherein the rear wall defines a rear wall cavity having an upper wall, a lower wall, a heel-ward wall, and a toe-ward wall, all extending into the hollow main body, and wherein the hollow main body defines a central axis along which the head is intended to move when being used to strike a golf ball;

providing a plurality of weight cartridges, each comprising a polymeric housing and a weight, wherein the polymeric housing defines an elongated cavity sized and configured to conformably receive the weight;

wherein the plurality of weight cartridges all have substantially the same size and shape and each are configured to conformably fit into the rear wall cavity, and wherein the plurality of weight cartridges, together, have a range of weights;

selecting a particular one of the plurality of weight cartridges having a weight that will combine with the weight of the hollow main body to provide a desired total weight; and installing the selected weight cartridge in its installation position in the rear wall cavity by sliding the cartridge into the cavity from outside the hollow main body, along an axis substantially aligned with the central axis, where it is retained without the need for a screw attachment, thereby producing a golf club head having the desired weight.

21. A method as define in claim 20, wherein the plurality of weight cartridges provided in the step of providing have weights that range from about 1.5% to about 8% of the combined weight of the cartridge and hollow main body.

22. A method as define in claim 20, wherein the plurality of weight cartridges provided in the step of providing range in mass from about 3 g to about 16 g.

23. A method as define in claim 20, wherein:

the rear wall cavity formed in the step of forming is substantially aligned with the central axis;

the rear wall cavity has a substantially rectangular cross-section in planes perpendicular to the central axis; and the polymeric housing of each weight cartridge, provided in the step of providing, and the rear wall cavity, formed in the step of forming, together include a ridge and groove structure that retains the weight cartridge in its installation position by a snap fit.

24. A method as define in claim 20, wherein the rear wall cavity formed in the step of forming, and the polymeric housing of each weight cartridge, provided in the step of providing, both are dimensioned in a direction from the heel to the toe greater than they are dimensioned in a direction from the sole to the crown.

25. A method as defined in claim 24, wherein the rear wall cavity formed in the step of forming is spaced above the sole of the hollow main body.

26. A method as define in claim 20, wherein:

each of the plurality of weight cartridges, provided in the step of providing, includes a plurality of weights;

each of the plurality of weight cartridges includes a polymeric housing having a plurality of elongated cavities sized and configured to conformably receive the plurality of weights;

each of the plurality of weight cartridges includes a polymeric housing having a top wall, a bottom wall, a forward wall, a left side wall, a right side wall, and a rear wall; and when the selected weight cartridge is installed in its installation position in the rear wall cavity, substantially only the rear wall of the housing of the cartridge is visible.

27. A method as defined in claim 26, wherein:

the elongated cavities defined by the polymeric housing of each of the plurality of weight cartridges, provided in the step of providing, include at least three cavities, each having a substantially circular cross-section; and the plurality of weights included in each of the weight cartridges each have a substantially circular cross-section and are sized to fit snugly within one of the plurality of elongated cavities.

28. A method as define in claim 26, wherein the plurality of weights of the plurality of weight cartridges, provided in the step of providing, each comprise a material selected from the group consisting of polymers, aluminum, steel and tungsten.

* * * * *